US006659439B1

(12) United States Patent
Baumgartner et al.

(10) Patent No.: US 6,659,439 B1
(45) Date of Patent: Dec. 9, 2003

(54) QUICKLY ADJUSTABLE MULTIPLE CLAMPING SYSTEM

(75) Inventors: Beat Baumgartner, Baar (CH); Eduard Zängerle, Richterswil (CH)

(73) Assignee: Triag AG, Neuägeri (CH)

( * ) Notice: Subject to any disclaimer, the term of this patent is extended or adjusted under 35 U.S.C. 154(b) by 0 days.

(21) Appl. No.: 09/959,725

(22) PCT Filed: May 5, 2000

(86) PCT No.: PCT/CH00/00251

§ 371 (c)(1),
(2), (4) Date: Jan. 18, 2002

(87) PCT Pub. No.: WO00/67952

PCT Pub. Date: Nov. 16, 2000

(30) Foreign Application Priority Data

May 6, 1999 (CH) ..... 849/99

(51) Int. Cl.[7] ..... B25B 1/20

(52) U.S. Cl. ..... 269/43; 269/137; 269/212; 269/246

(58) Field of Search ..... 269/15, 43, 73, 269/97, 134, 137, 171, 210, 212, 246, 248, 256

(56) References Cited

U.S. PATENT DOCUMENTS

| | | | | | |
|---|---|---|---|---|---|
| 540,413 | A | * | 6/1895 | Vanderbeek | 269/137 |
| 2,511,843 | A | * | 6/1950 | Graether | 269/15 |
| 3,088,729 | A | | 5/1963 | Marcus | |
| 3,515,444 | A | * | 6/1970 | Grabner | 384/15 |
| 4,918,846 | A | * | 4/1990 | Tsukada | 384/15 |
| D346,942 | S | * | 5/1994 | Sawdon | D8/72 |
| 5,324,013 | A | * | 6/1994 | Marino | 269/137 |

FOREIGN PATENT DOCUMENTS

| | | |
|---|---|---|
| EP | 0 229 717 A2 | 7/1987 |
| GB | 2 144 233 A | 2/1985 |
| GB | 2 245 202 A | 1/1992 |

* cited by examiner

*Primary Examiner*—Joseph J. Hail, III
*Assistant Examiner*—Daniel Shanley
(74) *Attorney, Agent, or Firm*—Browdy and Neimark, P.L.L.C.

(57) ABSTRACT

A rapidly adjustable multi-clamping device with at least one clamping module, which is adjustable along the base and can be locked in place thereon, wherein teeth for positioning the clamping modules are provided on the base and on the clamping modules.

3 Claims, 3 Drawing Sheets

QUICKLY ADJUSTABLE MULTIPLE CLAMPING SYSTEM

BACKGROUND OF THE INVENTION

1. Technical Field of the Invention

The invention relates to a rapidly adjustable multi-clamping device with at least one clamping module, which is adjustable along the base and can be locked in place thereon, wherein teeth for positioning the clamping modules are provided on the base and on the clamping modules.

2. Prior Art

Clamping devices of this type are employed for clamping workpieces during processing, in particular by means of machine tools, processing centers, etc. In connection with known constructions (for example EP-A-0 229 717, GB-A-2 245 202, U.S. Pat. No. 5,324,013) the locking in place of a clamping module or of a detent body on the base takes place by means of one or several screws, which vertically penetrate through the module, or the body, and are anchored in a T-groove in the base, which extends in the adjustment direction.

Object and Summary of the Invention

It is the object of the present invention to propose a clamping device, whose clamping modules can be adjusted (displaced) completely without interference along the base, and can also be exchanged as rapidly as possible.

This object is attained in accordance with the invention in that each clamping module has a shaft located on top transversely in relation to the displacement direction, which is in contact with two straps arranged on both sides of the module by means of right- or left-handed threads, and that the straps extend past the module and the base with flaps, wherein the flaps extend the straps by approximately 1 to 2 mm and each has inclined faces, which are intended for resting against the respective inclined faces of the module and on the base in such a way that by rotating the shaft and an appropriate change in the distance between the straps, the straps are guided and not twisted, and a connection between the clamping module, or the base is provided, or severed.

By means of the invention it is achieved that a clamping module can be displaced without interference, or even completely removed (exchanged), merely by operating the shaft.

Brief Description of the Drawings

The invention will be explained in greater detail by means of exemplary embodiments in connection with the drawings.

Figure 1:
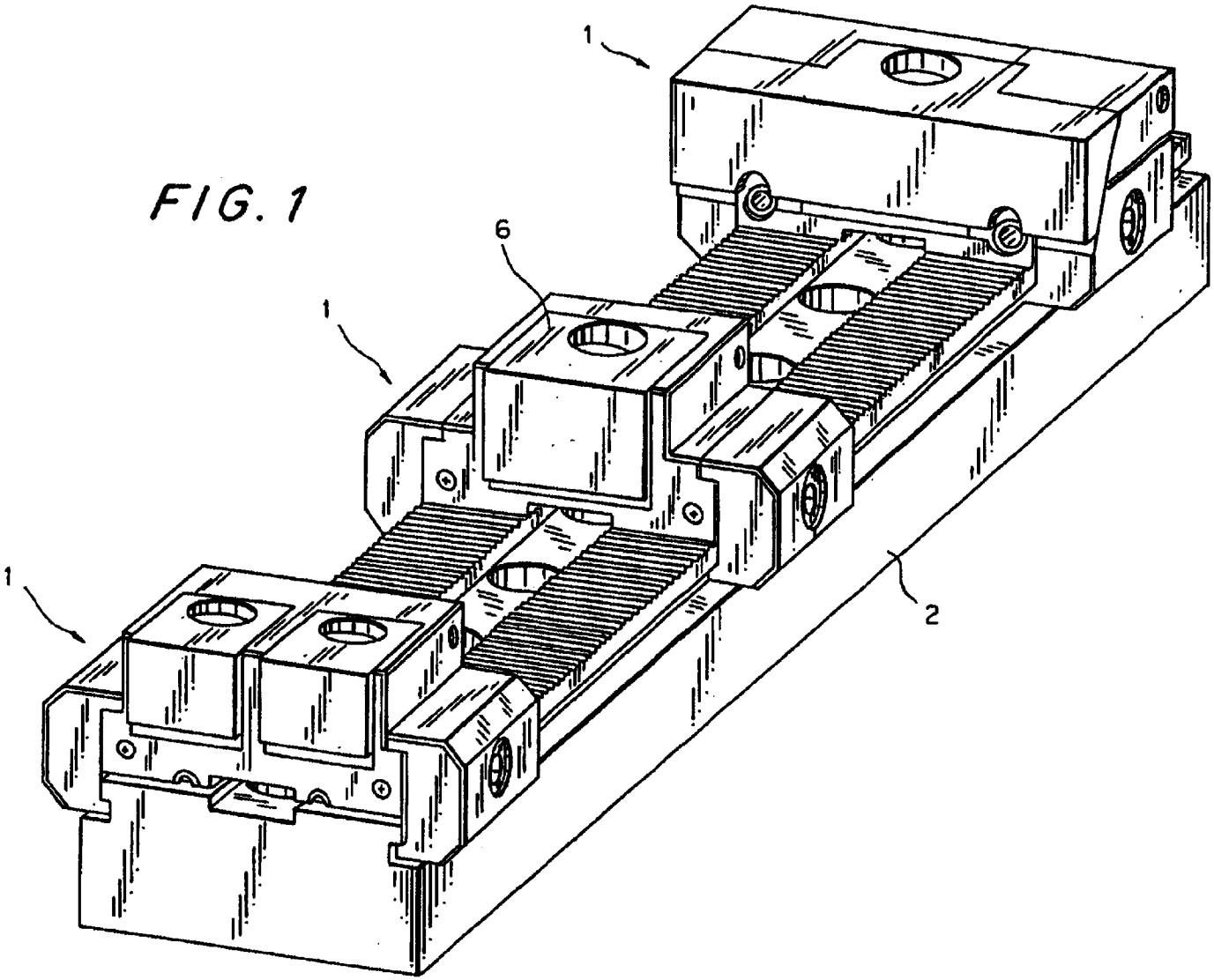
FIG. 1 perspectively represents a modularly constructed multi-clamping device with the basis and three types of clamping modules (clamping carriage)
Figure 2:
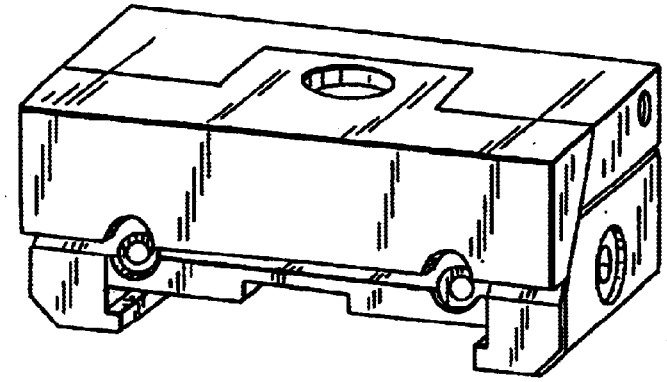
FIGS. 2 to 4 show each one of the three clamping modules of FIG. 1 separately, end
Figure 3:
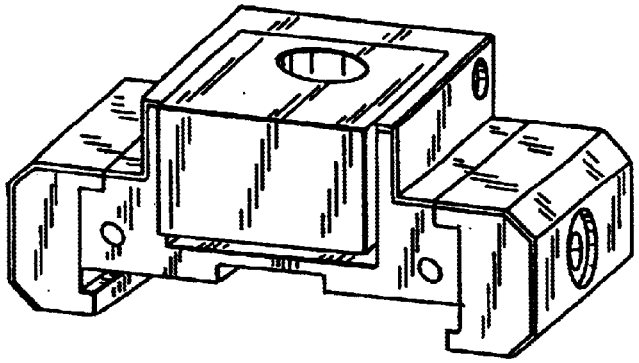
Figure 4:
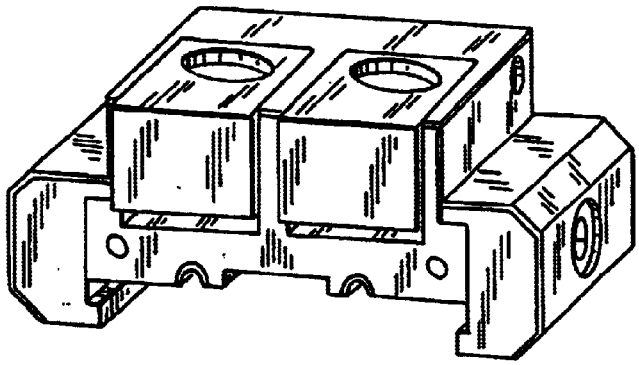
Figure 6:
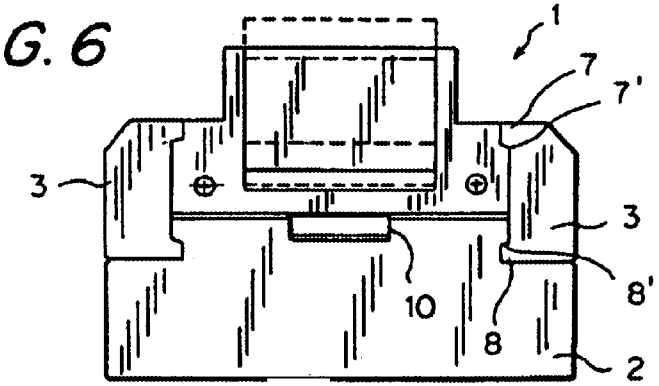
FIG. 6 shows a front view of the module of FIG. 5.
Figure 7:
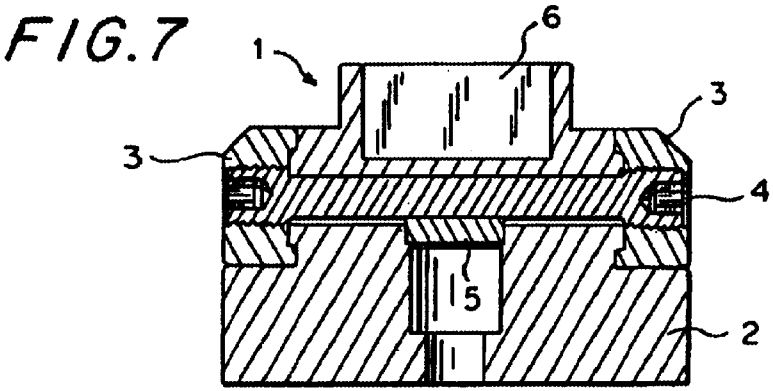
FIG. 7 shows a longitudinal section of the module of FIG. 5.
Figure 5:
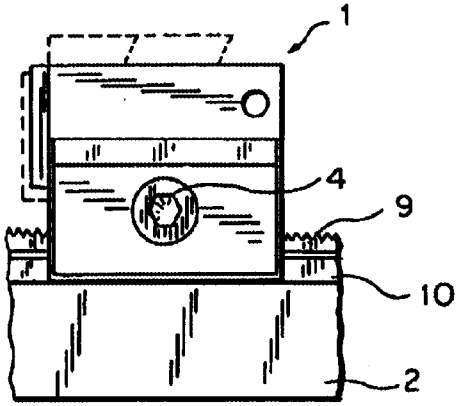
FIG. 5 shows a clamping module placed on the base in a lateral view (5)
Figure 8:
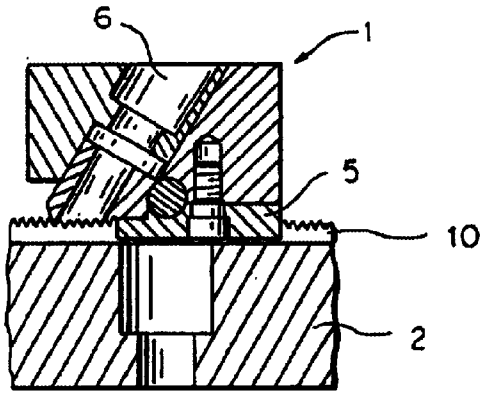
FIG. 8 shows a cross section of the module of FIG. 5.

In a manner known per se, a multi-clamping device in accordance with FIG. 1 is used for clamping workpieces (not represented) for mechanical processing. Clamping modules 1 have been locked into place on a base 2, wherein various shapes of modules 1 can be employed, depending on the shape and size of the workpieces (also see FIGS. 2, 3 or 4).

The modules are positioned by means of teeth 9 provided on the base 2 and the clamping modules 1. The travel of the respective clamping jaw 6 is greater than the spacing between the teeth 9, so that a workpiece of any size can be clamped.

For adapting the respective workpieces, a rapid displacement of the clamping modules along the basis is required, or modules of different types must be exchanged. To this end, the clamping modules 1 and the base 2 are designed in the following manner (see FIGS. 5–8)

The clamping module 1 has a shaft 4 located on top transversely in. relation to the displacement direction. It is placed above the teeth 9 and is maintained on the module 1 by means of a wedge 5. Respectively one strap 3 is located on either side of the modules, wherein the shaft 4 is in engagement with the straps 3 by means of right- or left-handed threads. The straps 3 extend over the module 1 and the base 2 by means of flaps 7, 8. Each has two inclined faces 7',8', which are intended for resting against corresponding inclined faces on the module and on the basis.

By rotating the shaft 4, the straps are pulled together or pushed apart, depending on the direction of rotation. In this way a simple connection between the clamping module and the basis is either provided, or severed. The beginning of the threads in the shaft 4 and the straps 3 are defined, so that both straps come to rest simultaneously.

The flaps 7, 8 of the straps 3 are extended by approximately 1 to 2 mm, so that the straps are guided and do not twist on the module when being released.

The wedge 5 holding the shaft 4 is designed as a sliding block, which fits into a guide groove 10 in the base 2. The clamping module is laterally centered on the base in this way.

It is possible to connect various clamping modules, devices, supports, detents, etc. with the base 2 in this way.

What is claimed is:

1. A rapidly adjustable multi-clamping device comprising:

at least one clamping module (1), which is adjustable along a base (2) and can be locked in place thereon, wherein teeth (9) for positioning the clamping module are provided on the base (2) and on the clamping modules (1), wherein each clamping module (1) has a shaft (4) located on top transversely in relation to the displacement direction of the clamping module, the shaft being in contact with two straps (3) arranged on both sides of the module by means of right- or left-handed threads, the two straps (3) extending past the module (1) to the base (2) with flaps, wherein the flaps extend the straps transverse to the base by approximately 1 to 2 mm and each has inclined faces, which engage against respective inclined faces on the module and on the base in such a way that when rotating the shaft (4) and changing a distance between the straps (3) the straps are guided and not twisted on the base, and a connection between the clamping module (1), and the base (2), is either provided, or severed.

2. The clamping device in accordance with claim 1, wherein the shaft (4) is held in the displacement direction on the clamping device (1) by means of a wedge (5) which is designed as a sliding block and fits into a center groove (10) provided in the base (2).

3. The clamping device in accordance with claim 1, wherein a clamping jaw (6) is provided on the clamping module to facilitate clamping a workpiece.

* * * * *